United States Patent [19]

Turner

[11] 4,418,602

[45] Dec. 6, 1983

[54] TRANSFER ORGAN

[76] Inventor: William D. Turner, 12804 Cedarbrook La., Laurel, Md. 20708

[21] Appl. No.: 397,695

[22] Filed: Jul. 13, 1982

[51] Int. Cl.[3] ..... G10H 1/02

[52] U.S. Cl. ..... 84/1.26; 84/1.01; 84/1.19

[58] Field of Search ..... 84/1.19, 1.01, DIG. 18, 84/1.26, 454, 1.03

[56] References Cited

U.S. PATENT DOCUMENTS

| | | | |
|---|---|---|---|
| 3,647,928 | 3/1972 | Turner | 84/DIG. 4 |
| 3,809,792 | 5/1974 | Deutsch | 84/1.24 |
| 3,978,755 | 9/1976 | Woron | 84/DIG. 4 |
| 4,012,982 | 3/1977 | Southard | 84/1.24 |
| 4,027,101 | 5/1977 | DeFrettas et al. | 84/DIG. 26 |
| 4,033,219 | 7/1977 | Deutsch | 84/1.24 |
| 4,063,034 | 12/1977 | Peters | 84/DIG. 26 |
| 4,099,439 | 7/1978 | Luce | 84/1.24 |
| 4,109,208 | 8/1978 | Tomisawa et al. | 328/13 |
| 4,111,092 | 9/1978 | Adachi | 84/1.24 |
| 4,122,803 | 9/1978 | Deutsch | 84/DIG. 4 |
| 4,128,032 | 12/1978 | Wada et al. | 84/1.19 |
| 4,143,327 | 3/1979 | Welsh | 84/1.19 |
| 4,147,083 | 4/1979 | Woron et al. | 84/1.01 |

*Primary Examiner*—F. W. Isen

*Attorney, Agent, or Firm*—Henry C. Nields

[57] ABSTRACT

The disclosed organ employs keyboard-activated transfer of individualized tone and envelope-generating information from large memories for each distinctive set of a note's harmonics, to small memories in small circuits corresponding to each harmonic set. Selection of large memories programmed for different temperaments or voice types renders the organ playable as one or another type of organ (e.g., gothic, classical, romantic, theater) in a variety of temperaments (e.g., just-temperament, mean-tone, equal-temperament). Information transferred from any selected large memory causes a circuit common to one or more sets of a note's harmonics to sweep the harmonic data transferred to the small memories for all the note's harmonic sets, to generate respective currents representing attack and decay envelopes for all the note's harmonic sets. Interruption and resumption of currents corresponding respectively to tonal attack and decay are effected immediately, so as to preclude unnatural delays in the activation of these keying phases. The currents representing attack and decay envelopes modulate waveform amplitude currents generated from data transferred to associated small memories. The modulated waveform currents are summed and applied to decouplers which enable a four-element stereophonic system to generate a two-dimensional sound image duplicating that of organ pipes spatially distributed in various configurations and pipe settings.

3 Claims, 9 Drawing Figures

CIRCUIT F. COMPONENT

TRANSFER ORGAN

BACKGROUND OF THE INVENTION

The present invention is an improvement of my co-pending application, Ser. No. 293,273 filed Aug. 17, 1981, which is a continuation-in-part of my application, Ser. No. 044,071 filed May 31, 1979 and now abandoned.

A transfer organ is an electronic organ which exactly duplicates the known properties of pipe organ sound, without employing permanent individual generating circuits for each separate tone. The instrument achieves complete individuality of each tone through keyboard-key-initiated, selective transfer of individualized tone-forming information from large memories for a note's voice to identical tone generating circuitry for as many keys as are activated at a given time. When a key is depressed, the organ circuit locates an available tone generating section, transfers the tone generating information to the section's circuits, and temporarily couples the key to the tone section by storing the key's code number so that the tone section can respond to further manipulation of that key. When the key is finally released and all of its keyed tones have completely decayed, the tone section is uncoupled from the key and cleared for possible coupling to another depressed key.

The stored, temporarily transferred, tone forming information can readily represent individualized tonal parameters essential to duplication of major properties of pipe organ sound. Such individualized parameters include among others:

(1) waveform throughout tonal attack, sustain, and decay;
(2) amplitude throughout tonal attack, sustain, and decay;
(3) tone frequency;
(4) overall keying phase durations, or lengths of attack and decay; and
(5) bidimensional, stereophonic decoupling of the sound of each note from that of every other note.

Dynamic keying circuitry permits duplication of the effects of tracker keying in a pipe organ.

Musical intervals which generate no beats are sometimes characterized as "perfect", or "pure". Early Western peoples had little liking for musical dissonance, and employed in their music, diatonic "just-temperament" scales having a small number of simple, interdependent numerical relations between their tone frequencies, no dissonances within the few commonly used musical intervals, excessive dissonances in uncommonly used intervals, few or no playable chords, and playability in only a single key. As cultural tolerance for dissonances increased, slight mistuning of several musical scale notes produced chromatic "mean-tone temperament" scales having perfect thirds, near-perfect fifths, reduced dissonances in other intervals, playable chords, playability in any musical key through employment of several extra keyboard keys, and useful musical contrasts between more and less dissonant intervals. Much excellent instrumental music was written for mean-tone temperature. By about 1700, however, chromatic "equal temperament" scales became the universal tuning pattern for most instruments, including pipe organs. Equal temperament scales have constant frequency ratios between all their adjacent notes, no perfect intervals except the octave, tolerable dissonances in most intervals, more playable chords, and playability in any musical keys without the help of extra keyboard keys. A small number of mean-tone concert pipe organs are being built today, contributing to a revival of the music written for them. It would be highly desirable, but difficult and prohibitively expensive, to construct a two-temperament pipe organ capable of playing both 15th and 17th Century music in the respective temperaments for which they were written.

While the large memories in my said co-pending application are programmable for any desired temperament, the said co-pending application disclosed no sufficient means enabling a single transfer organ to select and play in more than one temperament. No multi-temperament electronic organ can be found in the prior art. The prior art discloses electronic organs comprising various means for selecting different nominal organ voices other than those activated by initial arrays of stops, but no means for selecting different organ voices duplicating the known properties of pipe organ sound, or for selecting different musical temperaments.

My said co-pending application involves the keyboard-key-initiated transfer of tone forming information from large memories to small memories in pluralities of tone generating units. However, each tone generating unit contains a keying-phase control circuit which must be differently plugged or switched to generate (1) main tone attack or decay, (2) initial transients during tonal attack, or (3) terminal transients during tonal decay, through controlled setting and resetting series of cascaded flip flops. Each tone generating unit also contains an envelope-generating system comprising a first counter which presets a second counter which in turn causes a shift register to shift applied waveform data. The shifts of the waveform data generate normal power functions. A register-adder circuit inverts a generated power function during one half of an attack or decay interval, so that resulting sequences of normal and inverted power functions constitute sigmoid functions. Presetting of the first counter by a third counter varies the output pulse rate of the first counter, which pulses clock the shift register, thereby determining at once, both the steepness of the generated, ascending or descending sigmoid functions and the overall rate of tonal attack or decay. Thus, in the said system, the overall duration of attack or decay is an inherent inverse function of the steepness of the generated sigmoid function, so that the system cannot vary duration and steepness independently of each other. Generation of the sequences of sigmoid changes in harmonic amplitudes, evident in so many instances of organ pipe attack and decay, require complete tone generating units and large memories for each sigmoid pattern in the envelope of each harmonic of each note.

My recent analyses of the keying envelopes of the harmonics of various kinds of organ pipes have yielded envelopes which not only are complex in form, but which also differ quite substantially and individually for corresponding harmonics of different pipes within each given voice, as well as in different voices which bear different, or even the same, names. Such complex and markedly different envelopes within an organ voice contribute to their voice's signature, or distinctive quality, but as a rule only when they are played in coherent melodies, chords, or counterpoint, somewhat as a familiar human voice often becomes recognizable only when it changes in pitch and quality. By employing large pluralities of tone generating units and large memories for each harmonic of each note, my said co-pending application can duplicate such keying envelopes. However, the volume of required circuitry is economically impractical. The prior art discloses no other, practical means for such duplication.

In my said co-pending application, when a depressed key is released before tonal attack is complete, the initiated attack runs its course before the resulting decay begins. Similarly, when a released key is depressed before the initiated decay is complete, the decay runs its course before the resulting attack begins. Such effects constitute unnatural delays in the organ's responses to interrupted or resumed keyings. The prior art comprehends no means for naturally responsive interruptive or resumptive keying which is also individualized for each separate note.

My said co-pending application discloses means for decoupling pitches within each voice from one another, and for decoupling voices as wholes from each other, to generate an orthogonal two-dimensional sound image duplicating that of organ pipes distributed in a rectangular array, with lower pitches heard as coming from more distant sources, higher pitches heard as coming from nearer sources, and different voices heard as coming from different lateral locations before the listener. The said means comprise pitch decouplers preset by transferred tone-forming information and generating two versions of given tone frequency currents, and voice decouplers preset by switches, receiving the combined output pairs of the said pitch decouplers, and generating four versions of the tone currents. When the four outputs of the voice decouplers are applied to four amplifier-speaker systems constituting a two-dimensional stereophonic system, the said orthogonal sound image is generated.

When, instead, the four outputs of the voice decouplers are applied to four corresponding multiresonant filter sets, when the transfer characteristics of the respective filter sets represent the reenforcement and cancellation effects of sound reflection and refraction in the four corners of a partially open pipe organ chamber, and when the respective outputs of the four filter sets are applied to the four corresponding speaker systems, the resulting two-dimensional sound image is that of organ pipes distributed within such a chamber.

The active, analog filters for such sets are difficult to fabricate because of their collective complexity, lack of standardization of their components, and highly critical values of their comprised resistors and capacitors, with corresponding susceptibility to drift with changes in temperature, humidity, and time. While active, digital filters would be free of such drift, their collective complexity and their need for individualized fabrication detract from their practicability.

The prior art discloses no single circuit comprising stable standardized components and enabling an electronic organ to generate simultaneously, different patterns of individualized decouplings of pluralities of tone currents, in simultaneous duplication of the sounds of different spatial configurations of organ pipes in open or partially enclosed pipe settings.

SUMMARY OF THE INVENTION

The present invention comprehends an improved digital electronic transfer organ. The disclosed improvements include inventive means for (1) selecting more than one musical temperament, voice array, or both, (2) duplicating highly complex individualized envelopes of attack and decay of different sets of organ pipes' harmonics, (3) effecting immediate responses of tonal attack and decay to their interruptive or resumptive keying, and (4) effecting simultaneously, different patterns of mutually decoupled notes in duplication of the sound of various spatial arrays of unenclosed or partially enclosed organ pipes.

To enable the inventive instrument to select different temperaments, organ voice arrays, or both together, the present invention employs means for member-selective transfer of corresponding tone forming information from any selected pair of a plurality of large memories to the same given array of small memories. Means contributing to such transfer include the said plurality of large memories, gates for transmitting the outputs of the large memories to the small memories, and switching means for selecting the gates corresponding to the large memories whose stored information is to be transferred. In the present invention, the said transfer is effected for different large memories, by the same memory-sweeping counters and associated circuits, and, the transfer is to the same small memories. Thus, the invention requires only selectable arrays of differently programmed large memories to enable a transfer organ to select different temperaments, voice arrays, or combinations thereof. With only the circuitry described in the present disclosure, the inventive instrument is fully compatible with equal-temperament, mean-tone, or other types of keyboard.

To generate keying envelopes of attack or decay having any required degree of individualized complexity while preserving their sigmoid properties, the present invention employs keyboard-key-initiated transfer of envelope-forming information from a large memory to a small envelope memory in a first small circuit corresponding to a note's component. A note's component is herein understood to comprise a first set of one or more of its harmonics whose variously complex attack and decay envelopes are closely similar in shape while differing variously in general amplitude level, and differing substantially and individually in shape from the envelopes of harmonics in other sets of the note's harmonics. Since each said component may comprise more than one harmonic frequency, the waveform corresponding to any such component may be said to be a composite waveform, composed of the waveforms of the harmonic frequencies included therein. A counter in a second circuit of the invention, whose presettable output frequency sweeps (reads) the envelope's successive amplitude words in the small envelope memories corresponding respectively to the note's components, effects the patterns and overall durations of attack and decay of all the note's components. Presetting of the first said counter by transferred envelope-duration informtion, and by a third counter in the invention's dynamic keyer circuit for all notes keyed by the key, governs the overall magnitudes of the keying phase durations. Also, the envelope data which are stored in the large envelope memory and selectively transferred to the appropriate small envelope memories in consequence of keyboard-key depression, can represent sigmoid functions of any requisite degree of steepness, thereby enabling the steepness and duration of any portion of an envelope of harmonic attack or decay to vary independently of each other, as in pipe organs.

Thus the invention requires a first said small circuit and large memory for each tonal component only, and not an entire tone generating unit for each sigmoid portion of a variously complex envelope for each harmonic. It has been found that close similarities in the shapes of keying envelope of some different harmonics make it possible to duplicate pipe organ sound through generation of a small number of components for given notes, and that generation of somewhat larger numbers of components may be required for duplication of the sound of a particular voice of a particular pipe organ. However, it is neither necessary, possible nor desirable for any one organ pipe to duplicate exactly the sound of any other organ pipe, and electronic duplication of pipe organ sound does not require duplication of particular organ pipes. The sound of an organ voice is determined by the values of its statisticaal parameters, and pipe organ sound can be preserved as these parameters are made to vary quite extensively. Pipe organ sound quality deteriorates, however, when the parametric values are such as to exclude quasi-random variations from one individual note to another.

As noted, harmonics whose dynamic patterns of amplitude differ only in general amplitude level can belong to the same component of a note. When different portions of a harmonic's pattern of amplitude change are similar respectively to those of two or more differing components, the harmonic can generally be made a member of each such component. The combined outputs of the components then reconstruct the harmonic's distinctive pattern of amplitude change.

The present improved transfer organ comprises means for immediate response of tonal attack or decay to interruptive or resumptive keying of such phases. Initial complete key depression initiates in an up-down counter, an up-count which causes associated circuits to begin generation of tonal attack. Complete release of the depressed key before the attack ends reverses the count-direction of the up-down counter to a down-count which causes the said associated circuits to initiate tonal decay at the point at which the attack was interrupted, and not only after the interrupted attack has ended. Similarly, an initial complete key release initiates in the up-down counter, an up-count which causes the associated circuits to begin generation of tonal decay. Complete depression of the released key before the decay ends reverses the count-direction of the up-down counter to a down-count which causes the said associated circuits to initiate tonal attack at the point at which the decay was interrupted, and not only after the interrupted decay has ended. The said means similarly enable immediate resumption of interrupted attack and decay. Therefore, the general result of the said means is a transfer organ's increased responsiveness to interruptive and resumptive keying.

The invention's said first small circuit also comprises digital-to-analog converters (DACs) which respectively generate (1) analog waveforms corresponding to information transferred to the swept small waveform memory, and (2) analog envelopes corresponding to information transferred to the swept small envelope memory. The output of the envelope converter modulates the output of the waveform converter, to generate waveforms manifesting patterns of attack and decay.

My said co-pending application comprises partly switch-controlled means for first decoupling tone signals to duplicate the sound of orthogonally related arrays of organ pipes, and further non-standard filter means for modifying the decoupled signals to duplicate the reflective and refractive effects of a partially open pipe chamber. To duplicate the sound of variously patterned spatial distributions of unenclosed and partially enclosed organ pipe arrays, the present invention comprises only standardized circuitry whose individualized decoupling of notes is determined entirely by temporarily transferred tone information. The net effect is to generate directly any desired relative amplitudes of currents for given tones, in four channels which are applied directly to four speaker systems in a two-dimensional stereophonic array. Thus, the sound of any desired, spatially distributed array of organ pipes in any pipe setting is duplicated by corresponding programming of the improved transfer organ's large memories. In the corresponding means, the analog currents representing keying-modulated waveforms are summed by mixing resistors and applied to a decoupler circuit comprising four multiplying digital-to-analog converters (MDACs) which multiply the applied analog currents in various degrees determined by individualizing tone forming information transferred from a large voice memory to small memories for the note. The four outputs of the said decoupler circuits for different notes are then combined into four channels common to the notes, said common channels being applied to four associated speaker systems composing a two-dimensional stereophonic array.

Objects of the invention are:

to enable a transfer organ to be played in selectable tone temperaments and voice arrays;

to enable a transfer organ to generate highly complex and individualized arrays of attack and decay envelopes of harmonics of given tones, including the sigmoid changes in harmonic amplitudes which characterize the said envelopes;

to enable a transfer organ to respond immediately to keyed interruptions and resumptions of attack and decay;

to enable a transfer organ to duplicate simultaneously the sounds of variously patterned spatial distributions of unenclosed or partially enclosed organ pipes; and to enable a transfer organ to realize the above said objects with practical amounts of completely standardized circuitry.

DESCRIPTION OF THE DRAWINGS

FIG. 1 employs 2-place numbers to identify its parts. FIGS. 2–8, inclusive, show circuits identified by letters A–H, inclusive, block symbols for these circuits in FIG. 1 bearing the same letters. To relieve crowding within FIGS. 2–8, inclusive, a circuit's letter is omitted from the 3-place number symbol of each part lying within the figure for the circuit. In the disclosure, and in a figure's marginal indications of the connections of its parts with those in other figures, circuit letter symbols introduce the marginal members of the other figure's parts.

FIG. 1 is a block diagram of illustrative circuits A–G, inclusive, and their salient inteconnections, comprised by an illustrative keyboard module of the inventive, improved transfer organ. A transfer organ keyboard module corresponds functionally to a pipe organ division which comprises a keyboard and associated stops for playing primarily the pipe arrays which are specified by the stops.

FIG. 2 is a diagram of first and second illustrative Circuits A, or "key" circuits, which generate key-state signals, disable and enable key-scanning, and signal Circuit B to generate corresponding key codes.

FIG. 3 is a diagram of Circuit B, or "(key) coder", which interconnects Circuits A and other circuits, and generates key codes.

FIG. 4 is a block diagram of Circuit C, or a "module" circuit, comprising a transfer circuit for selective transfer of tone forming information from one or more selected pairs of large memories (for example, voice PROMs for envelopes and waveforms) to small memories in Circuits E, F, and G, described below. The module circuit in FIG. 4 comprises also a (tone-) section-scanner circuit for locating particular Circuits D–G, inclusive, which are currently available for tone generation in response to an activated key.

FIG. 5 is a diagram of Circuit D, or an illustrative "(tone) section" circuit, comprising a coupler for temporarily coupling arrays of Circuits E–G, inclusive, to active keys, and a dynamic keyer circuit for making the overall durations of tonal attack and decay proportional to the durations of key transitions during key depression and release.

FIG. 6 is a diagram of a Circuit E, or an illustrative "voice" circuit, for implementing voice stop and keyboard-key initiation and termination of keying phases (attack, decay), for interrupting and re-activating such keying phases, for generating digital representations of corresponding overall keying phase durations, for generating digital representations of tone frequencies, and for addressing corresponding small memories (RAMs) in Circuit F.

FIG. 7 is a block diagram of a Circuit F, or illustrative "component" circuit, comprising small waveform and envelope memories (RAMs), means for enabling these memories for writing (transfer) and reading (tone generation), means for converting the digital outputs of these swept memories to analog signals, and means for modulation of the analog waveform signals by the analog envelope signals.

FIG. 8 is a block diagram of an illustrative Circuit G, or "decoupler" circuit, for generating four versions of a given note's tone currents, the versions differing in amplitude, and the amplitude differences varying from one note to another. The four respective versions for different notes are combined into four common channels which are applied to four corresponding speaker systems in a two-dimensional array before the listener.

DISCLOSURE OF A PREFERRED EMBODIMENT

Figure 1:
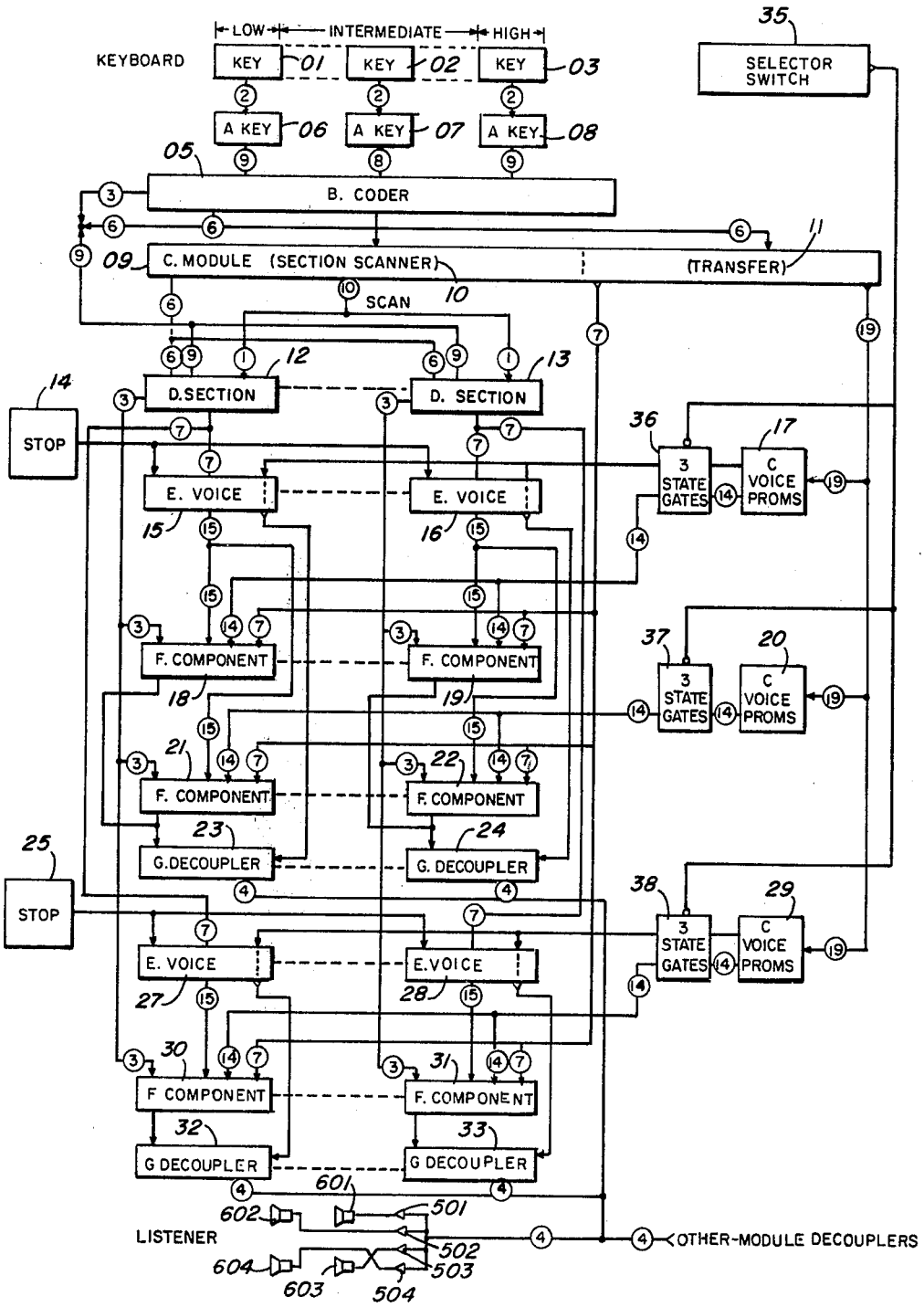
In FIGS. 1–8, inclusive, lines corresponding to multiple channels contain encircled numerals designating the numbers of included channels. Symbols for open-collector elements enclose a letter O. Symbols for three-state elements enclose a numeral 3.

FIG. 1. Improved transfer organ, keyboard module

The top row of illustrative elements 01, 02, 03 in FIG. 1 represents altogether 61 keys of a conventional 61-key equal tempered organ manual keyboard. (A corresponding pedal keyboard would normally comprise 32 keys.) The figure shows all corresponding, illustrative Circuits A 06, 07, 08 as connected also to the module's single Circuit B 05 whose main functions are to generate key codes and connect the Circuits A 06, 07 08 with each other and with other circuits of the module.

Each circuit A is shown to be associated with a different keyboard key. Partial depression of a keyboard key conditions its associated Circuit A to hold a possible key scan so that the Circuit A can transmit signals representing key-states to other circuits, and enable Circuit B to generate the corresponding key code for guidance of information transfer and tone generation.

A keyboard module further requires a single Circuit C 09 which comprises two sub-circuits: (1) a transfer circuit 11 for the selective transfer of tone-forming data from large voice memories to small memories in the tone circuits, and (2) a tone-section scanner 10 for locating tone sections that are currently available for coupling to keys and generation of tones.

The outputs of the illustrative large memories (voice PROMs) 17, 20, 29 are shown as applied to corresponding three-state gates 36, 37, 38 which are selectively activated by a member-manipulated selector switch 35. By the term "member-actuated" or "member-manipulated" I mean that the selection is accomplished by means of members, such as the hands or feet of the operator of the keyboard module, activating appropriate selection apparatus such as the selector switch 35. Selector switch 35 can be connected so as to control gates 36, 37, 38 for any single voice or module, any array of voices or modules, or all voices and modules of a transfer organ. The outputs of the illustrative gates 36, 37, 38 are shown as applied to Circuits E and F whose functions are described below:

Below Circuit C 09, the figure shows two illustrative columns comprising illustrative Circuits D–G, inclusive, each of which columns in its illustrative entirety is herein understood to constitute a tone section. When the tone section scanner 10 in Circuit C 09 has located a currently available tone section, the transfer circuit 11 in Circuit 09 causes selected tone-forming data for all tones in the section (all of which tones are potentially sounded by the depressed key) to be transferred from all of a module's large memories (illustrative voice PROMs 17, 20 and 29) to small memories in the tone section's Circuits E, F, and G for all voices in the module, whether or not any voice stop (e.g., 14 or 25) in the module is set. Such simultaneous transfers not only minimize overall transfer time, but, more importantly, prepare any corresponding tone to sound normally, should its stop be set after the key is depressed.

The Circuit D 12, 13 at the head of each tone section coordinates the functions of the remaining circuits, and itself comprises three functionally distinct sub-circuits; (1) a (key-to-tone-section) coupler; (2) key-state latches; and (3) a dynamic keyer.

When a coupler receives a key code from Circuit B 05 (signifying partial key depression in this instance), if also the key code has not been latched already by another coupler, and if the tone section is currently available for tone generation, the coupler transmits an IT (initiate transfer) signal to the transfer circuit 11 in Circuit C 09. When the resulting transfer is complete, the transfer circuit 11 transmits a TC (transfer complete) signal to the tone section's Circuit D 12 or 13 which then effects the coupling by latching the key code and current key-state signals. The Circuit D 12 or 13 transmits the latched key-state signals to a counter in its dynamic keyer, causing the counter to start a count which is normally terminated and latched when the key's depression is complete. The resulting count presets a second counter to count at a rate corresponding to the average rate at which the key was depressed. The said count rate causes associated Circuits E and F to effect a corresponding overall duration of the tone's attack. Therefore, the overall duration of tonal attack varies with the key-transit time required for its depression, as in a tracker pipe organ. The dynamic keyer counters respond similarly to the transit time of key release, causing the overall duration of tonal decay to correspond to that of such release.

When the dynamic keyer's timing count is complete, a signal is also transmitted to associated Circuits E, which signal combines with the transmitted key-state signals to cause the associated Circuits E to turn on counters generating respectively (1) a memory-preset, optimally mistuned tone frequency for the corresponding tone, and (2) a further, memory-preset frequency determining an overall duration of attack (or decay) characteristic of the particular tone and subject to modification by the dynamic keyer as indicated above. If the key is released before tonal attack is complete (or depressed before a tonal decay is complete), the tone then decays (or attacks). If the key is depressed again before the decay is complete (or released again before the attack is complete), the attack (or decay) then resumes. Such actions by the Circuits E duplicate the effects of interrupted and resumed keying of organ pipes.

As shown in FIG. 12 of my said U.S. Pat. No. 4,338,849, the actual "note" (i.e. the actual tone frequency) generated by the counters of Circuits E is mistuned and therefore differs from the "nominal pitch" of the depressed key. For example, if the nominal pitch of "middle C" (C1) of the keyboard (for the particular temperament involved) is, say 258.652 Hertz, the "note" (i.e. the actual tone frequency) generated might be 258 Hertz or 259 Hertz. Therefore, each nominal pitch has associated with it a family of permissible "optimally mistuned tone frequencies", or "notes", one of which is selected for actual generation of an actual note.

Figure 9:
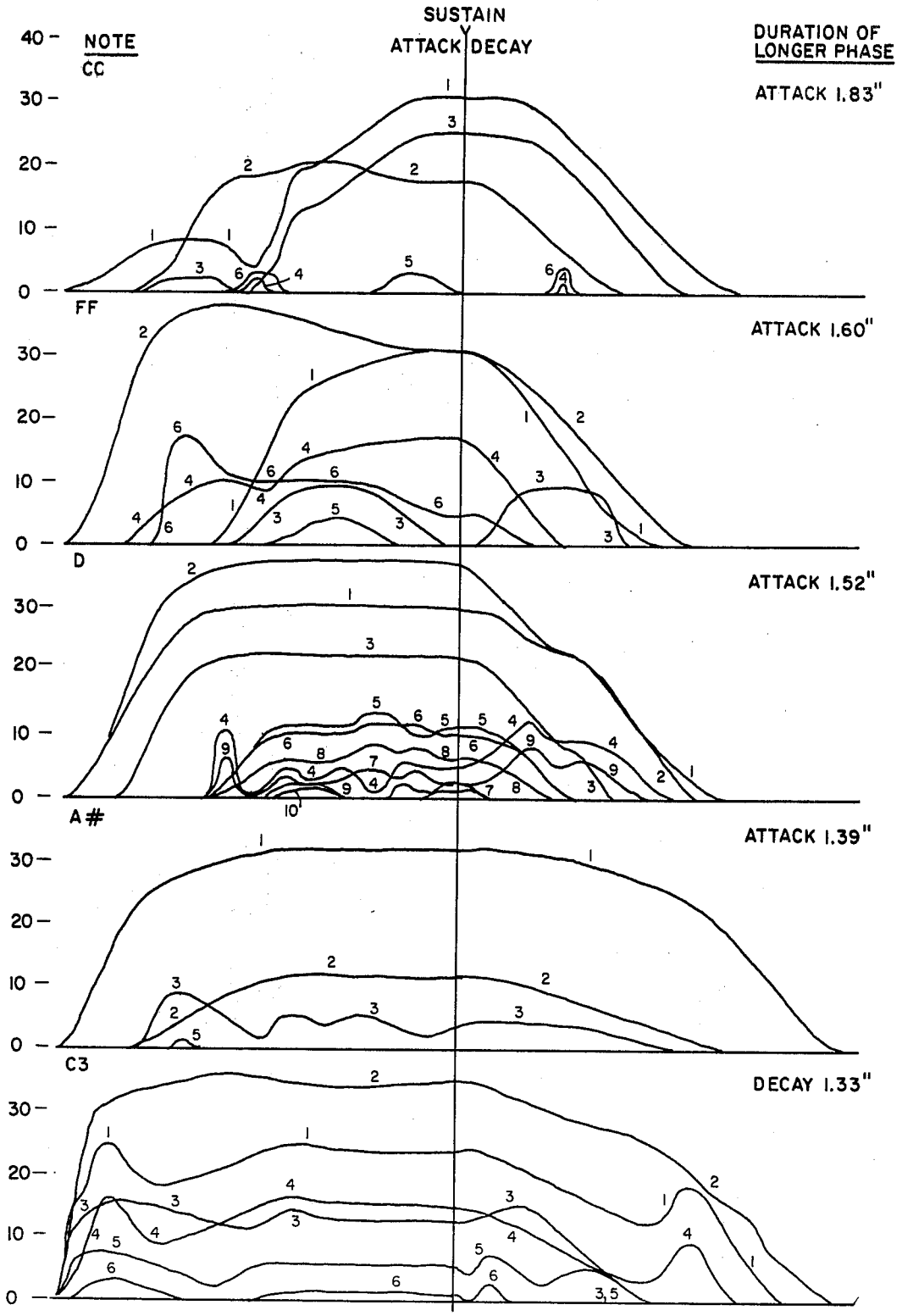
FIG. 9 is a selection of graphs of the envelopes of attack and decay of the harmonics present in five notes of an actual 8-foot diapason voice of a pipe organ. The curves illustrate the varieties of keying envelope that are economically duplicated by the improved transfer organ. The portions of the envelope curves at the left of the figure's vertical line are of harmonic attacks; those at the right of the figure's vertical line are of harmonic decays; harmonic values at the vertical line itself represent harmonic amplitudes during tonal sustain. Numerals shown along the curves are the corresponding harmonic numbers. The horizontal time scales of all five graphs are normalized to facilitate comparison of envelope patterns as such. Actual overall durations of the longer of a note's two keying phases are shown in real-time seconds at the right of each graph.

The tone frequency and attack (or decay) count rates generated in a Circuit E are applied to one or more associated Circuits F for a given note (Circuits F are the "small circuits" referred to in the above summary of the invention). Small memories in a Circuit F, whose transferred binary words are successively addressed by the frequency and count signals from their associated Circuit E, generate respectively a distinctive waveform representing a given tone-component, and a distinctive keying pattern of that component. As evident from the illustrative curves in FIG. 9, patterns of turn-on or turn-off of different sets of a note's harmonics (or tone components) may differ substantially and quite eomplexly from one component to another. In this event, a tone requires more than one Circuit F for its proper generation. When the respective currents generated by corresponding Circuits F for a given tone are combined into sound, a single tone having a distinctive pattern of attack or decay is heard. The tones of the illustrative voice controlled by stop 14 in FIG. 1, shown with two illustrative associated Circuits F, would sound in this manner.

FIG. 1 further shows combined outputs of a tone's Circuits F converging to a Circuit G, or decoupler circuit, for the tone. Circuit G applies the combined channels to the reference voltage ($V_R$) inputs of four MDAC's. A SIPO (serial-in-parallel-out shift register) applies to the binary inputs of its corresponding MDAC, binary signals which cause the MDAC to amplify the signal on its reference voltage input by a corresponding amount. The SIPO's binary signals represent the information transferred from a corresponding large memory (voice PROM 17, 20, or 29). The figure shows the resulting respective outputs of the illustrative Circuit G's MDACs combined with corresponding outputs from Circuit Gs for other notes, in four common channels. These common channels are applied respectively to four corresponding amplifier-speaker systems whose speakers are shown in a rectangular configuration before the listener.

The different sets of binary data applied to a decoupler's MDACs cause the amplitudes of the MDAC output currents to differ variously from each other, and the differences themselves to vary from one decoupler to another. The resulting differences between the amplitudes of two or more component signals within the decouplers' four common output channels represent various degrees of mutual independence of the signals, or of their mutual decoupling. When the four common channels are applied to four corresponding loudspeakers which are spatially separated as shown, the speakers' spatial separations decouple the resulting sounds of each component signal in proportion to the magnitudes of the differences.

Also, when the amplitudes of a note's current are higher in speakers G602, G604 than in speakers G601, G603, a listener hears the resulting tone as though from a source near to him. When the said amplitudes are higher in speakers G601, G603 than in speakers G602, G604, the listener hears the tone as though from a more distant source. When the said amplitudes are higher in speakers G601, G602 than in speakers G603, G604, the listener hears the tone as coming from a source toward his left. When the said amplitudes are higher in speakers G603, G604 than in speakers G601, G602, the listener hears the tone as though coming from a source toward his right.

Thus, the transferred tone forming information can cause a first tone to be heard as coming from a first location, and a second tone as coming from a second location, in horizontal two-dimensional space. This means that a transfer organ's combined sound of two or more notes generates a sound image extended in two horizontal spatial dimensions, like the sound image of spatially distributed organ pipes. It is evident that the transferred, individualized tone forming information can produce the effects of pipes arranged in pitch files and voice ranks, or any other desired configuration, and the effects of enclosure of any configuration of pipes in a partially open pipe chamber.

Figure 2:
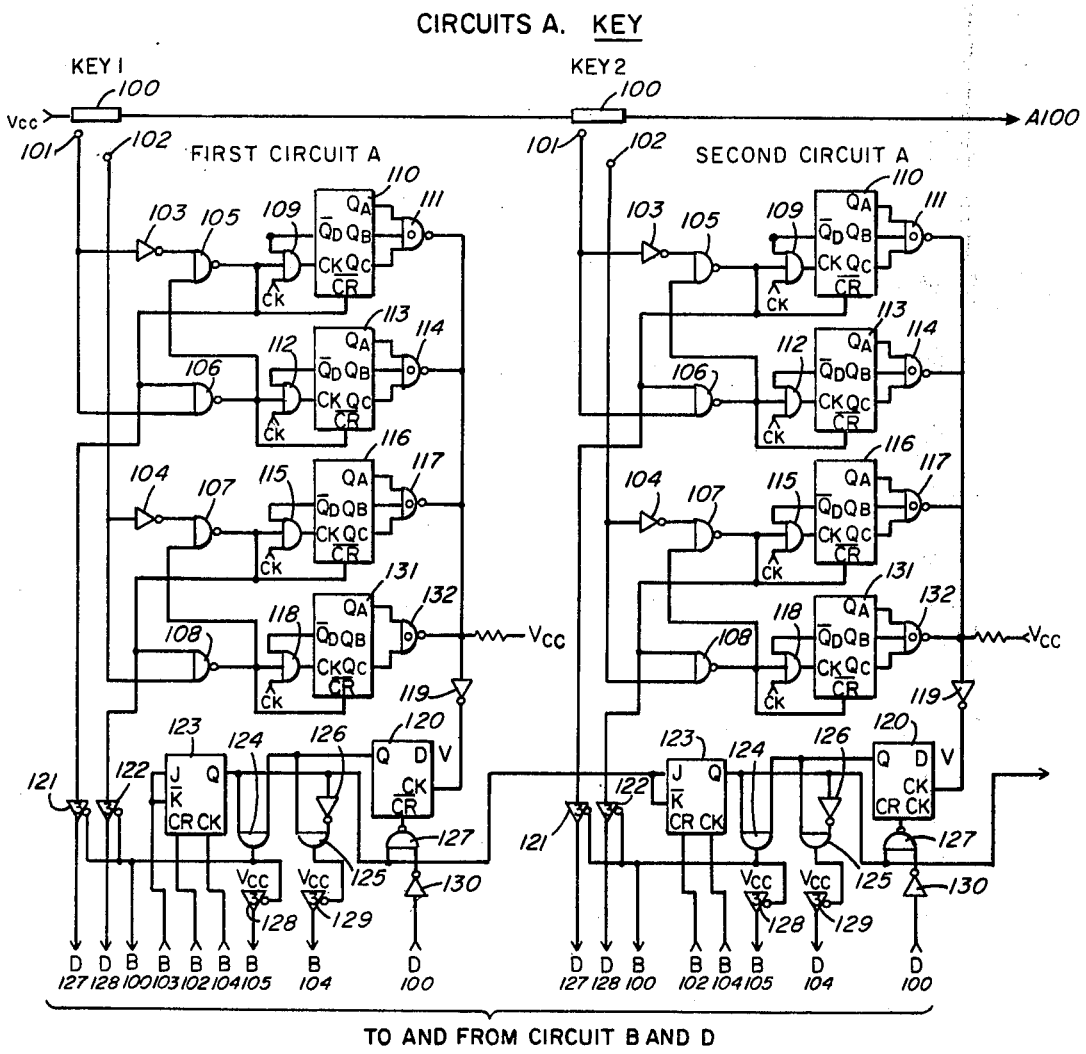
Figure 3:
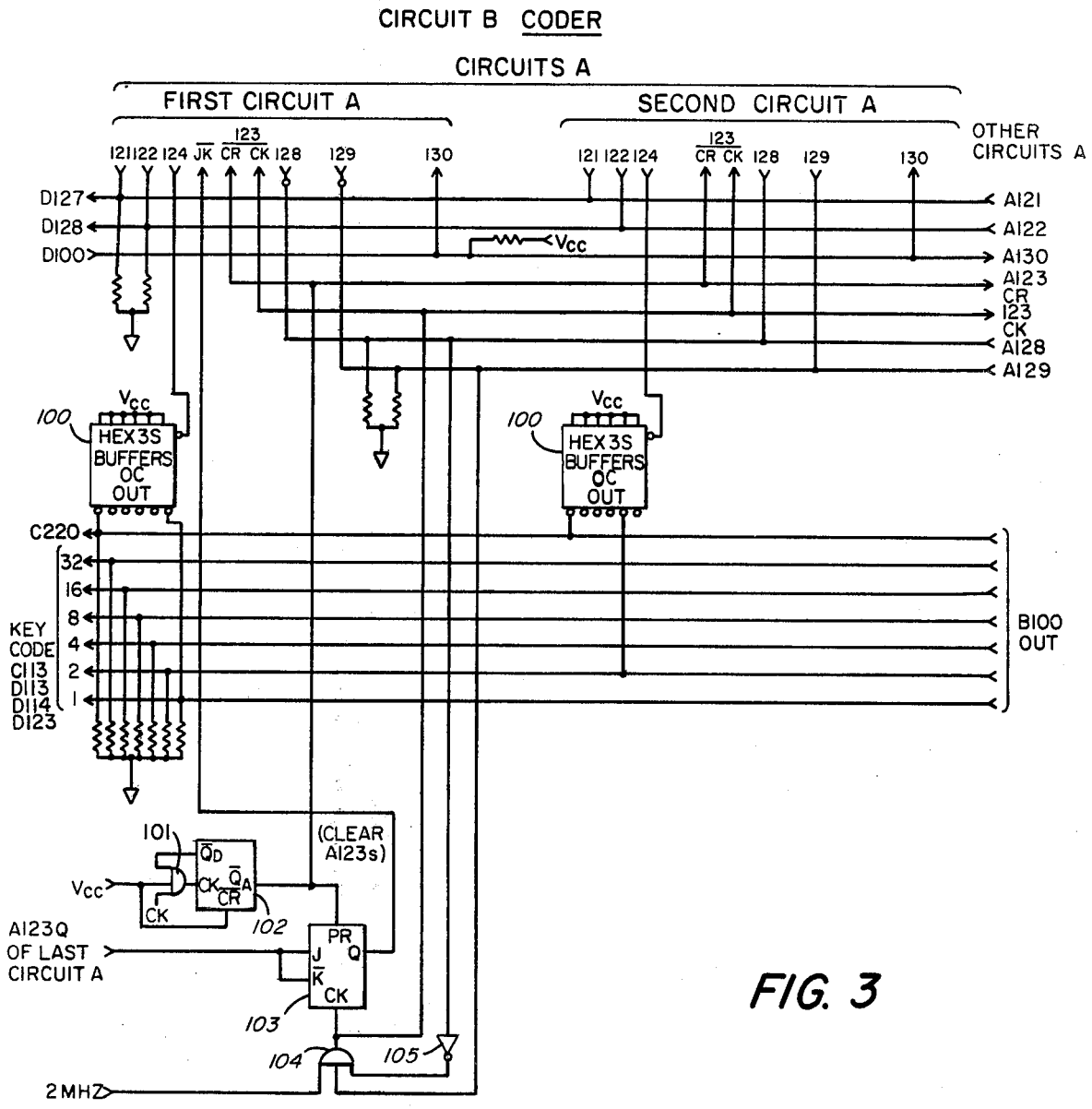

FIG. 2, Circuit A: key; FIG. 3, Circuit B: coder

FIG. 2 shows two illustrative Circuits A, each of which is fed by two inputs from two corresponding springs A101, A102 with which an energized, key-mounted element A100 makes and breaks contact as its associated key is depressed and released. Thus, when a key is in a fully released state, no connection exists between its element A100 and associated springs A101, A102. When the key is partly depressed, its element A100 is placed in contact with the associated spring A101, and when the key is fully depressed its element A100 makes contact also with spring A102. When the key is partly released, element A100 breaks contact with spring A102, and when it is fully released, element A100 breaks contact also with spring A101.

In the figure, 2-NANDs A105, A106 constitute a first flip flop (FF), and 2-NANDs A107, A108 constitute a second flip flop. High outputs of these flip flops cause one of the pulsing-counters A110, A113, A116, A131 to generate delay intervals and pulses. (A pulsing-counter is a two or more stage digital counter adapted from the prior art, triggered by a high signal which enables its clock input and drives its $\overline{\text{Clear}}$-input high. The $\overline{Q}$-output of a selected stage disables the count. Singly or in combination, the counter's various Q- and $\overline{Q}$-outputs provide signals representing delays, pulses, or other signals in various sequences and durations. A pulsing-counter substitutes for one or more 1-shot multivibrators having associated resistors and capacitors.)

In a Circuit A, a pulsing-counter generates (1) a delay during which switch-bounce signals from 2-NANDs A105-A108, inclusive, are completed, and then (2) a pulse which sets FF A120. The delay occurs as the pulsing counter counts to binary 6. At the next clock pulse, counter outputs $Q_A$, $Q_B$, $Q_C$ all go high, and, through OC (open collector) 2-NAND A111, A114, A117, or A132 and inverter A119, set FF A120. The next clock rise drives the counter's $\overline{Q}_D$-output low and, through 3-AND A109, A112, A115, or A118, disables the counter, thereby ending the count. In a Circuit A, the pulsing-counters may be clocked at 500 Hz, thereby generating a 0.012-second delay interval followed by a 0.002-second pulse. (Pulsing-counters in the other figures may be clocked at 2 megahertz.)

Thus, any made or broken contact between an element A100 and a spring A101 or A102 may persist long enough to set or reset an FF A105/A106 or A107/A108. If the new state of the FF persists long enough to trigger a pulser-counter, the pulsing-counter will begin generating its delay interval. Should a key-bounce signal reset a set FF or set a reset FF before the end of the delay and thereby disable the counting pulser-counter and trigger another pulsing-counter, the FF A120 will not be set until one of the pulsing-counters generates its complete delay interval—after a possible, slightly longer delay. Since a single delay interval masks all switch-bounce signals, a Circuit A positively debounces all made and broken contacts in the SPST switches constituted by element A100 and springs A101 and A102. The slightly longer delays that may be generated in a Circuit A do not detectably alter a transfer organ's responsiveness to keyboard key manipulation.

The setting of a Circuit A's FF A120 conditions the circuit to hold a key scan when the scan arrives at the Circuit A, as indicated further by the setting of the Circuit A's ring counter FF A123. Each FF A123 and is one of 62 FFs constituting altogether a ring counter in which FF B103 is the zero-count stage. When the instrument's power is turned on, a pulse from pulsing-counter B102 presets FF B103, and clears the FF A123 in each Circuit A.

Acting through 3-AND gate B104, a high output of any of the interconnected three-state buffers A128 disables, and a high output of any of the interconnected three-state buffers A129 enables, pulsing of the clock inputs of all FFs A123 and the FF B103, thereby enabling the ring count when a Circuit A is conditioned but no scan is on a conditioned Circuit A, and disabling the ring count when a scan is on a conditioned Circuit A.

Acting through 2-AND A124, the combined condition and scan cause three-state buffers A121, A122 to transmit two key-state signals to corresponding key-state latches D127, D128 in all the module's Circuits D, and, acting through a buffer B100 associated with the given Circuit A, to enable the tone section scanner through its 3-AND C220, and to transmit the key's binary code to a transfer-counter-presetting memory (PROM) C113 and a comparator D114 and associated coupler-latch D123. When the transfer circuit in Circuit C has completed the tone-information transfer and an available tone section Circuit D has coupled the key to that tone section, only the available Circuit D latches D127, D128 latch the applied key-state signals and, acting through inverter A130 and 2-NAND A127, reset FF A120, thereby deconditioning the Circuit A and releasing the ring counter to respond to a signal from another conditioned Circuit A.

Figure 4:
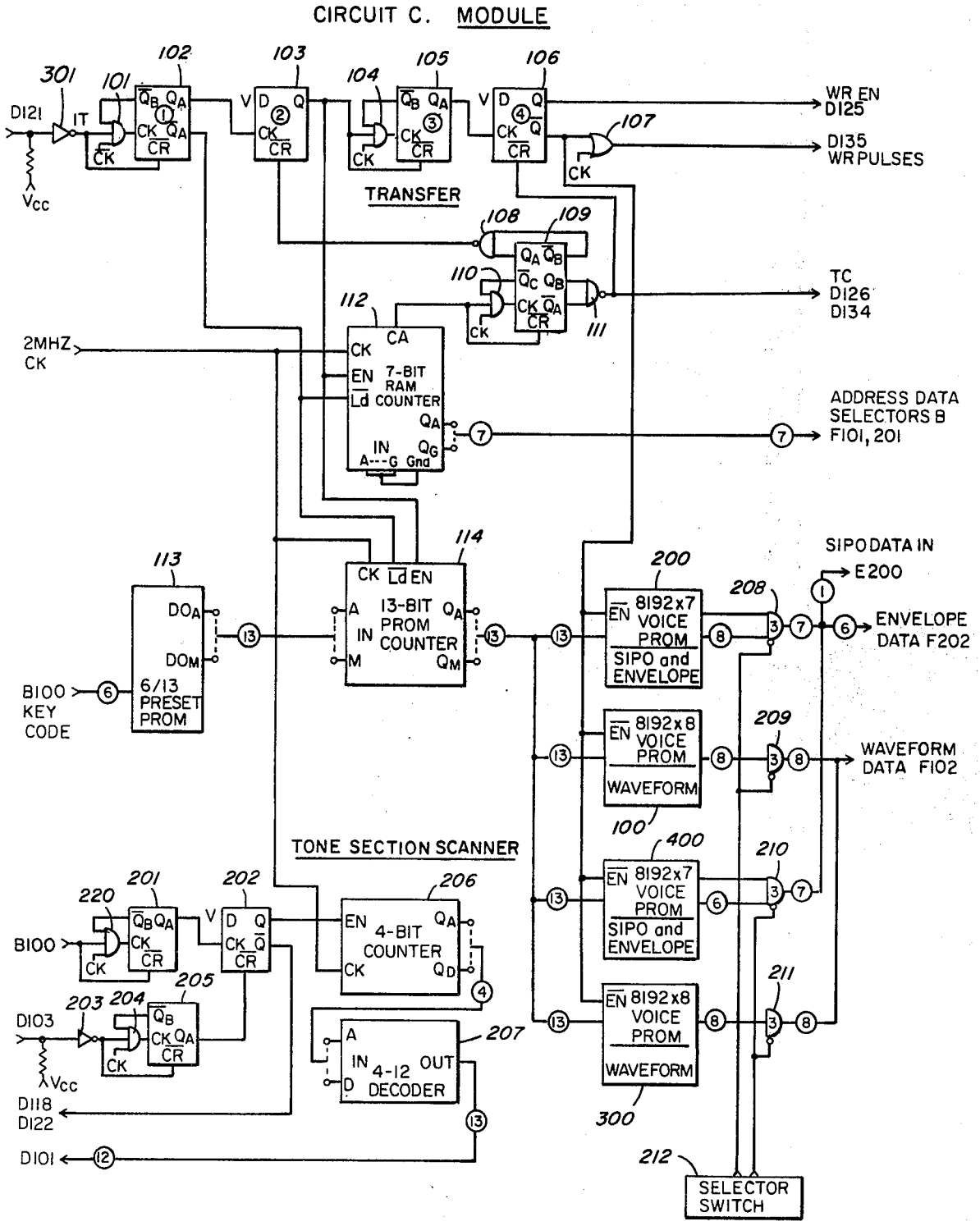

FIG. 4, Circuit C: module

FIG. 4 shows two illustrative pairs of large memories (voice PROMs) C200/C100 and C400/C300 whose outputs are applied to corresponding illustrative pairs of three-state AND gates C208/C209 and C210/C211. (To clarify the application of the memory and gate outputs to their respective destinations, a different three-state AND gate is shown for each large memory of a pair. In practice, a single 15-output three-state gate can accommodate the outputs of both of its associated large memories). Each said illustrative pair of large memories is programmed with tone forming information representing a distinctive voice, temperament, or both. Accordingly, each said pair may be said to correspond to a particular voice-temperament. Large memories having the word capacities indicated in the block symbols for the large memories C200, C100, C400, C300 shown in the figure, and stored, say, with mean-tone temperament data, would fully accomodate the shorter keyboards characteristic of mean-tone pipe organs for which music was written for that temperament. While such keyboards cover smaller pitch ranges and have at least one incomplete octave, they may have up to three extra (split) black keys in each full octave and two in an incomplete octave, making 9 extra keys within a 3½-octave keyboard comprising 53 keys in all. (A mean-tone keyboard covering five full octaves and comprising 76 keys in all would require a 6–14 preset PROM C113, large memories capable of storing 9728 8-bit and 7-bit words, respectively, and a corresponding fourteenth stage in the PROM-counter (C114.)

The figure shows the output-impedance-control inputs of the illustrative three-state AND gates C208, C209 as fed by a first illustrative output of a selector switch C212, and the said inputs of the illustrative three-state AND gates C210, C211 as fed by a second illustrative output of the said selector switch C212. The said selector switch can be a single-pole switch having as many switched outputs as there are tone temperaments or voice arrays to be selected. Such a switch can be connected so as to control any single voice or module, any pluralities of voices or modules, or all voices or modules of the improved transfer organ.

The figure shows the common corresponding outputs of the three-state AND gates C208–211, inclusive, as applied to the SIPO E200 and RAMs F202, F102.

When a Circuit D coupler's 2-AND D122 applies an IT (initiate transfer) signal to the pulsing-counter C102, RAM-counter C112 is loaded with binary zero, the PROM-counter C114 is loaded with the PROM binary address corresponding to the key code and generated by the preset PROM C113, and FF C103 sets for enablement of both counters C112, C114 at the next clock rise; pulsing-counter C105 which sets FF C106 and acts through 2-OR C107, transmits RAM-write pulses to the coupler's 2-OR D135. The WR EN (write enable) and pulse signals which are generated by the setting of FF C106 are applied to the currently involved Circuit D for distribution to its associated small memories (SIPOs, or serial-in-parallel-out shift registers; and RAM(s). The low $\overline{Q}$-output of FF C106 also enables the voice PROMs C100, C200, C300, C400.

The seven Q-outputs of the RAM-counter C112 address the 128 successive binary word locations in the RAMs F102, F202 in the involved Circuit F, while the thirteen Q-outputs of the PROM-counter C114 address 128 successive binary words in the voice PROMs C100, C200, C300, C400, beginning with the voice PROM address to which presetting-PROM C113 presets PROM-counter C114. The successive PROM C100 (or C300) 8-bit binary words are applied as waveform data to the succesively addressed locations in the involved RAM F102; successive PROM C200 (or C400) 6-bit binary words are applied as keying envelope data to the successively addressed locations in the involved RAM F202; and corresponding 1-bit outputs of PROM C200 (or C400) are applied serially to the 23-stage SIPO register E200 in the involved Circuit E, and thence to the 8-stage SIPO E128 in the Circuit E, and the four 8-stage SIPOs G101–G104, inclusive, in the involved Circuit G.

When the RAM-counter C112 count reaches 127, its high Carry (CA) output causes the 3-stage pulsing-counter C109, first to reset FF C103 whose resulting low Q-output disables counters C112, C114, and then to transmit a low TC (transfer complete) pulse to Circuit D's inverter D126 which sets FF D124 which in turn couples the active Circuit A and note section, and resets FF D134 which then conditions data-selectors F101, F201 and RAMs F102, F202 for reading (tone generation). The low TC pulse also resets FF C106, thereby disabling the write-pulse signals and voice PROMs.

The operation of the tone section scanner in Circuit C is indicated in the immediately following discussion of Circuit D.

Figure 5:
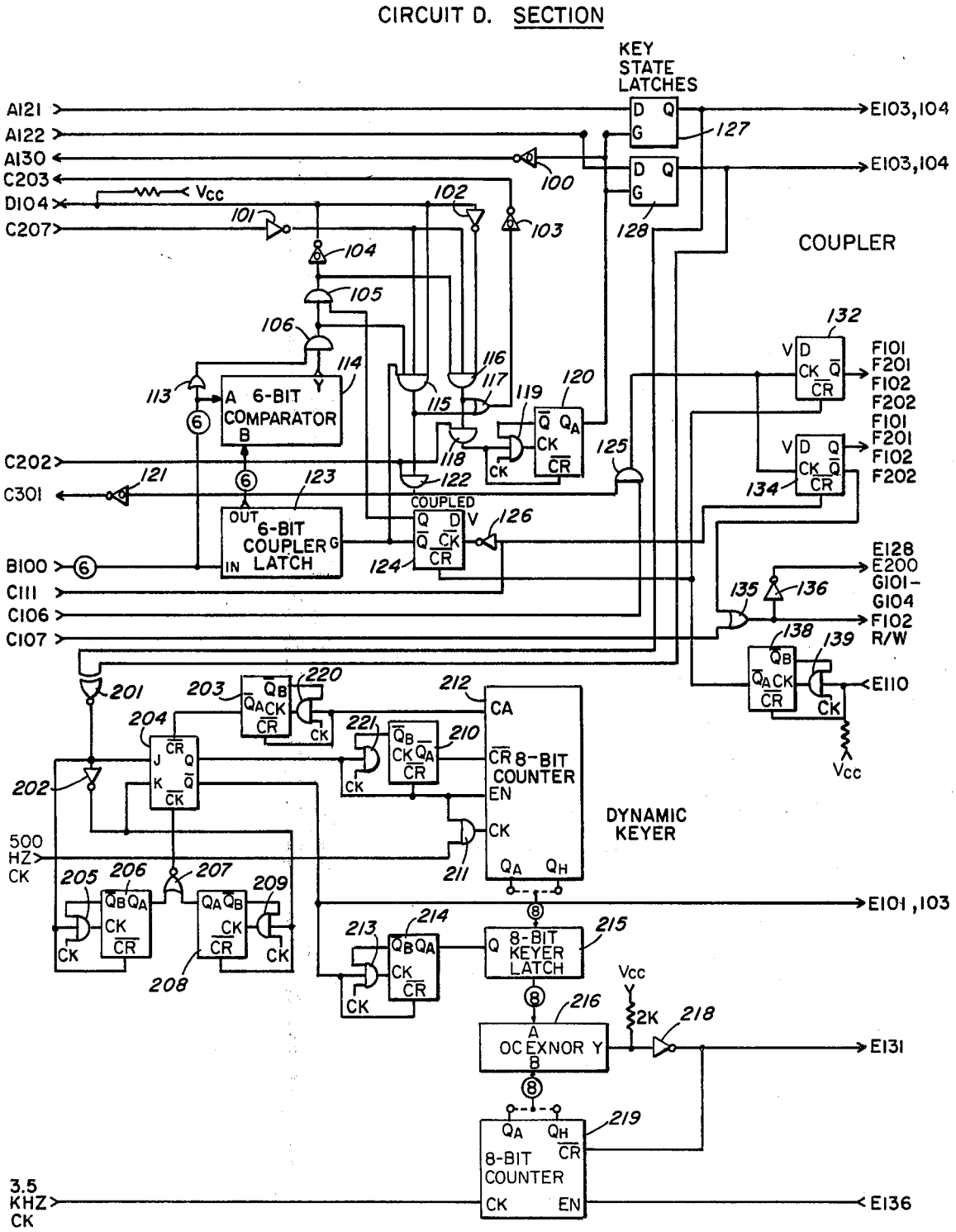

FIG. 5, Circuit D: section

The Circuit D in FIG. 5 shows that the key code is applied to the comparator D114, 6-OR D113, and coupler latch D123. The comparator's Y-output goes high when its binary A- and B-inputs are identical. When the applied binary signal consist entirely of binary zeros (as when all FFs A123 are cleared and FF B103 is preset), the output of the 6-OR D113 will be low and, therefore, the output of 2-AND D106 will be low, regardless of the comparator D114 Y-output. Thus, a high 2-AND D106 output signifies that the comparator's D114 binary A- and B-inputs not only are matched but also are not equal to zero, that is, that a ring counter FF A123 is set.

If Circuit D's coupler is not in a coupled state, its FF D124 $\overline{Q}$-output will be high, causing the latch D123 output to follow its input. The corresponding low Q-output of FF D124 holds the output of 2-AND D105 low, and the output of the OC (open collector) inverter D104 high. If, then, there is a match of not-zero key codes at comparator D114, and the tone-section scanner's low scan arrives at inverter D101, all inputs to 4-AND D115 will be high, disabling the tone-section scanner through 2-OR D117, OC inverter D103, pulsing-counter C205, and FF C202. A tone-section-scanner-disabled signal on 2-AND D122 then causes 2-AND D122 to transmit the IT (initiate transfer) signal to the Circuit C inverter C301. The IT signal then combines on 2-AND D125 with the resulting write-enable signal from FF C106 to set FFs D132, D134, which condition selectors F101, F201 and RAMs F102, F202 for writing (transfer). The low $\overline{Q}$-output of FF D134 or 2-OR D135 then releases write-pulses to RAMs F102, F202, and, through inverter D136, inverted write pulses to the cascaded SIPOs E200, E128, G101, G102, G103, G104.

When the transfer is complete, a low TC (transfer complete) pulse from the 2-AND C111 resets FF D134, disabling the write-operation and enabling the read-operation for tone generation. On inverter D126, the low TC pulse also sets FF D124, latching the impressed key code by latch D123, thereby coupling the active Circuit A to the tone section, and driving the output of 2-AND D105 high, and the outputs of inverter D104, 4-AND D115, and 2-AND D122, low, terminating the IT signal. The high outputs of 2-AND D105 and inverter D102 then combine with the high scan signal from inverter D101 to drive the output of 3-AND D116 high, which output in turn combines with the high $\overline{Q}$-output of FF C202 on 2-AND D118 to cause pulsing-counter D120 to pulse the key-state latches D127, D128, thereby latching the key-state signals and transmitting them to EXNORs (exclusive NORs) D201 of the dynamic keyer, and to 4-AND E103 and 4-NOR E104 of Circuit E.

When a further manipulation of the coupled key again places the coupled key code on the A-inputs of comparator D114, and the tone section low scan arrives on inverter D101, the output of 4-AND D115 remains low because its input from the $\overline{Q}$-output of the set FF D124 is low. However, the high scan output of inverter D101 and the high outputs of 2-AND D105 and inverter D102 drive the 3-AND D116 output high, again disabling the tone section scanner through 2-OR D117. The resulting high signals on 2-AND D118 again trigger the pulsing-counter D120 which causes latches D127, D128 to latch and transmit the new key signals to their destinations indicated above.

Thus, when a key code which is already coupled by a first coupler-a is impressed on all the couplers, and the tone section scan arrives at coupler-a, the corresponding key-state signals are latched by coupler-a without actuating the transfer again. Under such condition, and when the tone section scan arrives at a second coupler-b which has already latched a different key code, the discrepancy between its latched key code and the impressed key code holds low the Y-output of its comparator D114 and, therefore, the outputs of its 2-ANDs D106, D105, its 4-AND D115, and its 3-AND D116, so that the tone section scanner is not disabled by it. When, under the stated condition, the tone section scan arrives at a third coupler-c which has not already coupled any key code, the output of the coupler-c's 4-AND D115 will still remain low because the match-and-coupled state of coupler-a holds low the bus receiving the low output of coupler-a's OC inverter D104; also, the output of coupler-c's 3-AND D116 remains low because the low Q-output of its reset FF D124 holds the output of its 2-AND D105 low. Thus, under the stated condition, the note section scanner is disabled only by the conditioned coupler which has already coupled the impressed key code.

As will be indicated further in the discussion of Circuit E, below, completion of decay of all tones in a tone section following complete release of its coupled key, causes a high signal from all the tone section's OC inverters E110 to trigger pulsing-counter D138 whose low $\overline{Q}$-output pulse resets FFs D124, D132, thereby placing the tone section's RAM- and SIPO-controls at standby, and releasing the tone section for possible coupling to another key.

When latches D127, D128 latch new key-state signals, these signals are transmitted not only to Circuits E but also to EXNOR D201 of Circuit D's dynamic keyer. When one of the new key-state signals is high and the other low (signifying partial key depression or partial key release), FF D204 is set, clearing and then enabling and clocking counter D212. When both new key-state signals are either high (signifying complete key depression) or low (signifying complete key release), FF D204 is reset, disabling counter D212 at a count corresponding to the time taken by key-transit between a partial key-state and its corresponding complete key-state. Also, acting through pulsing-counter D214, the rising Q-output of FF D204 causes the latch D215 to latch the final Q-outputs of counter D212, which are then applied to EXNORs D216, thereby presetting counter D219 to reset each time it counts to the preset value.

If a key transit requires more than a half-second, the high Carry (CA) output of counter D212 will cause pulsing-counter D203 to reset FF D204, thereby preventing the application of spuriously small counts by counter D212 to latch D215. Thus, with this desirable exception, the more rapid the key transit, the more frequently will counter D219 reset within a given time interval. The resulting clear (CR) pulses from inverter D218 are applied as clock pulses to counter E131 whose clear pulses in turn clock counter E142. The Q-outputs of counter E142 address the successive binary words that have been transferred to the envelope RAM F202. By such means, the overall duration of tonal attack (or decay) is made to vary with the transit time of key depression (or release) within the usual speed range of key manipulations.

The resetting of FF D204, signifying the end of a key-transit-timing count, causes its high $\overline{Q}$ output-signal to be applied also to a pair of gates E101, E103, inclusive, to which new latched key-state signals are also applied, so that the key-state signals do not initiate a corresponding keying phase until the key transit is complete.

Figure 6:
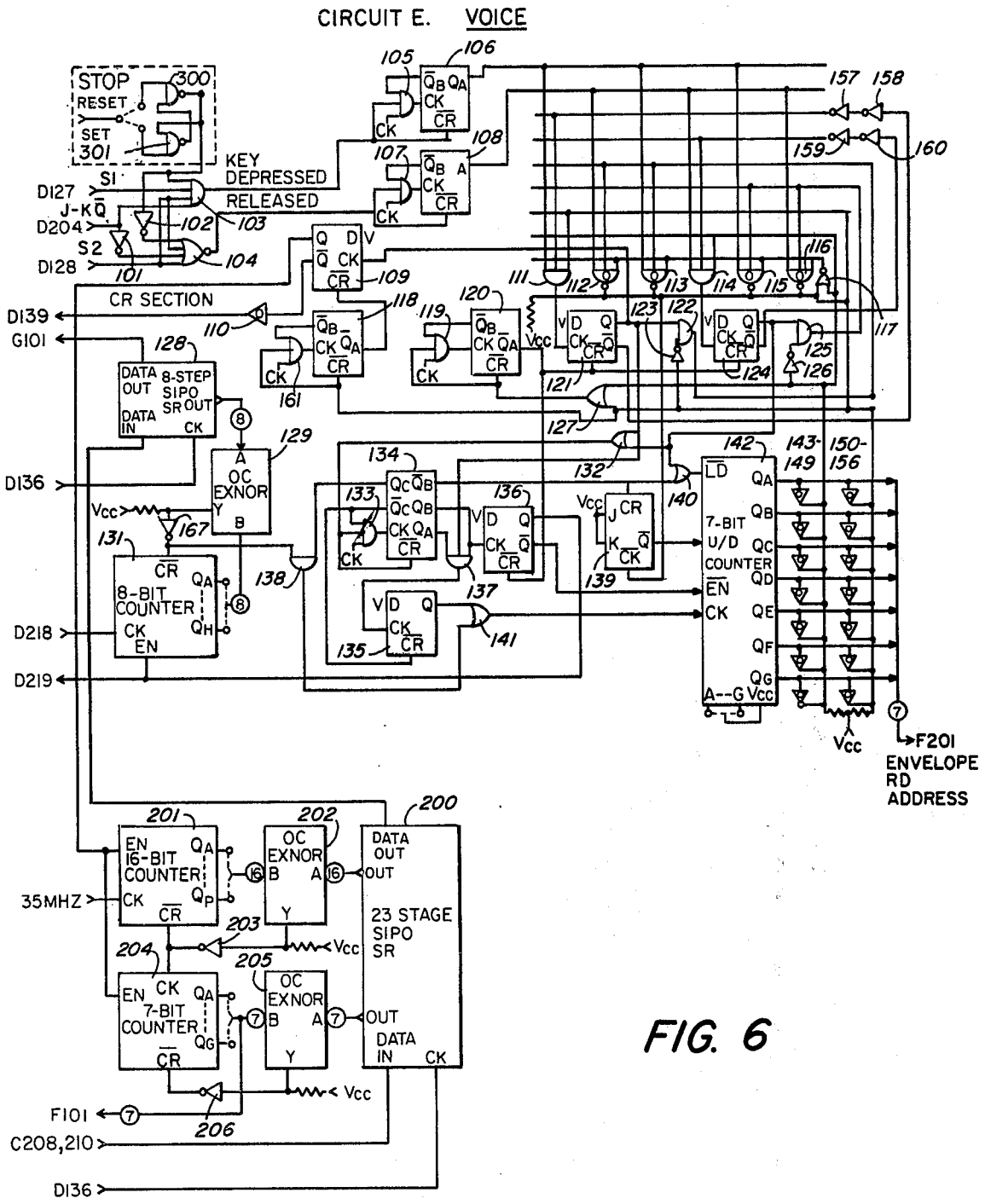

FIG. 6, Circuit E: voice

Circuit E comprises means for enabling and disabling envelope counters D219 in Circuit D, and E131, E142 in Circuit E. Circuit E also comprises the tone frequency counting elements E200–E206, inclusive, which are enabled and disabled by the latched key-state signals, dynamic keyer count completion, and stop setting and resetting, and therefore are entirely subject to a player's manipulation of keys and stops. The output of the voice stop's SPDT break-before-make switch-debouncing elements E300, E301 at the upper left of FIG. 6 must be high (signifying a set stop) for the key state signals and dynamic keyer signal to initiate and alter keying phases. Setting a stop after a key is completely depressed and the keyer count is complete will cause tones corresponding to the stop and key to turn on within an interval established by the latched count of the keyer counter D212. Resetting a stop while the key remains depressed will cause the tones to decay within an interval determined by the latched keyer count, whether the count was for tonal attack or tonal decay. Thus, it is seen that the control elements E101–E104, inclusive, enable stop and key manipulation to effect the same results in a transfer organ as in a pipe organ.

When the said control elements produce a high output of 4-AND E103, pulsing-counter E106 pulses the top channel in the connector matrix at the upper right of the figure. If also no tonal attack is already in progress and up-down counter E142 is in one of its quiescent states (its Q-outputs corresponding to binary 127), FF E121 is set, thereby triggering pulsing-counter E134 whose low $\overline{Q}_B$-output holds counter E142 for loading, and clears FF E139 whose resulting high $\overline{Q}$-output holds counter E142 for upcount (U). The concurrently high $Q_B$-output of pulsing-counter E134 sets FF E136 whose resulting low $\overline{Q}$-output holds counter E142 for enabling, and whose high Q-output enables the other envelope counters D219, E131. However, clocking outputs of these two counters do not activate counter E142 until its $\overline{Ld}$-input is made high.

It is seen that the high Q-output of the set FF E121 sets FF E109, whose high Q-output in turn enables the tone frequency counters E201, E204. No audible tone results, however, until the next rising clock pulse consolidates the loading, up-count setting, and enablement of counter E142, and then only after its $\overline{LD}$-input is driven high by the ensuing $\overline{Q}_B$-output of pulsing-counter E134. The consolidating clock pulse is provided by the high outputs from the pulsing counter E134's $Q_B$- and $Q_A$-outputs, which set FF E135 briefly to provide the pulse through 2-OR E141. The final, low $\overline{Q}_C$-output of pulsing counter E134 promptly resets FF E135, and the corresponding high $Q_C$-output of the pulsing-counter E134 applies the Clear pulses of counter E131 to the clock (CK) input of counter E142. The Q-outputs of counter E142 then address the first 64 successive binary words in envelope RAM F202, so that the waveform generated by counter E204's repetitive addressing of the 128 successive binary words in waveform RAM F102 results in sound—that is, tonal attack begins. Small, uncontrollable differences in the times at which counters E201, E204 for different tones keyed by the same key are enabled, render all tones of a transfer organ randomly independent in waveform phase, as are the sounds of organ pipes.

When counter E142 completes an up-count from zero to 63, OC buffers E143–148, inclusive, and the OC inverter E149 together trigger pulsing counter E120, whose low $\overline{Q}_A$-output pulse resets FFs E121, E136. The resulting low Q-output of FF E136 disables the envelope counters D219, E131, while its corresponding high $\overline{Q}$-output disables counter E142, thereby terminating the tonal attack. However, the tone frequency counters E201, E204 continue to count, so that any tone component they were generating at the end of tonal attack continues to sound until the tone's subsequent decay is completed.

It is seen that the SIPO register E128 applies in parallel to OC EXNORs E129 the data that were transferred serially to the SIPO E128. These data in effect preset counter E131 to clear at a rate causing counter E142 to read the words in envelope RAM F202 at a rate generally characteristic of rates of overall attack and decay of the particular tone. As already noted, the key-transit-speed presetting of counter D219 by counter D212 can modify this rate according to the average rate of key movement. Thus, the general level of such modifications remains consistent with the rate of overall attack or decay characteristic of the given tone, as in a pipe organ.

Similarly, SIPO E200 applies to EXNORs E202, E205, transferred data which cause the cascaded counters E201, E204 to generate a distinctive, optimally mistuned frequency for the particular tone. Programming of the voice PROMs C200, C400 enables Circuits E to generate arrays of tone frequencies which are (1) randomly selected, (2) normally distributed, (3) finely graded, and (4) in any desired degree of optimal mistune. Arrays of organ pipes "in good tune" manifest such patterns of mistune. In view of clocking of counters E201 by a single high frequency clock, it is apparent that a transfer organ, once programmed, can never get "out of tune".

When, during tonal sustain, a depressed key is completely released, the resulting key-state signals and dynamic keyer signal operate through the control elements E101–E104, inclusive, to cause pulsing-counter E108 to apply a pulse to the next downward channel in the Circuit E connector matrix. If also no tonal decay is already in progress, and the value of the counter E142 Q-outputs equals 63, FF E124 is set. The resulting high Q-output of FF E124 triggers pulsing-counter E134 again, but the counter E142 is prevented from loading a 63, by the high signal on the 2-OR E140 from the FF E124 Q-output. However, the low $\overline{Q}_B$-output of pulsing-counter E134 causes FF E139 to hold counter E142 for up-count, should events described below have toggled it to down-count (D). Again, the high $Q_B$-output of pulsing-counter E134 causes FF E136 to set again, thereby enabling counters D219, E131, E142 to generate the tone's decay. When the decay up-count reaches 127, the high outputs of buffers E150–E156, inclusive, trigger pulsing-counter E120 again, whose resulting low $\overline{Q}_A$-output resets FFs E124, E136, thereby disabling counters D219, E131, E142 and ending tonal decay. At the same time, the high signal from buffers E150–E156, inclusive, triggers pulsing-counter E118, whose low $\overline{Q}$-output resets FF E109, thereby disabling the tone frequency counters E201, E204.

The high $\overline{Q}$-output of the reset FF E109 also drives the output of the OC buffer E110 high. When the outputs of the OC buffers E110 for all the components in a tone section have thus been driven high, signifying completion of decay of all tones in the section, pulsing-counter D138 is triggered, whose low $Q_A$-output pulse resets FF D124, thereby uncoupling the coupled Circuit A and tone section, and releasing both for other possible couplings.

In FIG. 6 it is seen that, when the count of counter E142 does not equal 63, the outputs of one or more OC buffers E143–E148, inclusive, or of OC inverter E149, will be low, and that therefore the output of inverter E126 will be high. Similarily, if the counter E142 count does not equal 127, the outputs of one or more OC buffers E150–E156, inclusive, will be low, and the inverter E123 will be high. It is further seen that, if the count of counter E142 equals neither 63 nor 127, the output of 2-NOR 117 will be high. Also, as indicated above, a set FF E121 corresponds to an attack phase, and a set FF E124 corresponds to a decay phase. It is further seen that a low output of any of the OC 3-NANDs E112, E113, E115 or E116 on the clock (CK) input of FF E139 toggles that FF the changed value of whose Q-output then reverses the direction of the counter E142 count, thereby changing attack to decay, or decay to attack.

Thus, if a completely depressed key is completely released before a tone's attack is complete, the high outputs of 2-AND E122 and 2-NOR E117, and the high pulse from pulsing-counter E108, together cause OC 3-NAND E112 to toggle FF E139 to a set state, counter E142 to count down, and the attack to be interrupted by decay.

If the down-count of counter E142 is then allowed to progress back through zero to 127, counters D129, E131, E142, E201, E204 are all disabled, and the tone ceases as at the end of decay.

But if the prematurely and completely released key is again completely depressed before the counter E142 count-down reaches 127, the high outputs of 2-AND E122 and 2-NOR E117, and the high pulse from pulsing-counter E106, together cause OC 3-NAND E113 to toggle FF E139 to a reset state, counter E142 to count up again, and the interrupted attack to resume.

Such interruptions and resumptions of tonal attack can be effected repeatedly.

Similarly, if a completely released key is completely depressed before a tone's decay is complete, the high outputs of 2-AND E125 and 2-NOR E117, and the high pulse from pulsing-counter E106, together cause OC 3-NAND E115 to toggle FF139 to a set state, counter E142 to count down, and the decay to be interrupted by attack.

If the count-down of counter E142 is allowed to progress to 63, counters D219, E131, E142 are disabled, but the tone is held at its characteristic sustain amplitude by counters E201, E204, as at the end of attack.

But if the prematurely and completely depressed key is again completely released before the counter E142 count-down reaches 63, the high outputs of 2-AND E125 and 2-NOR E117, and the high pulse from pulsing-counter E108, together cause 3-NAND E116 to toggle FF E139 to a reset state, counter E142 to count up again, and the interrupted decay to resume.

As with attack, such interruptions and resumptions of tonal decay can be effected repeatedly.

It is seen that such interruptions and resumptions of tonal attack and decay occur immediately upon completion of key release or depression.

Figure 7:
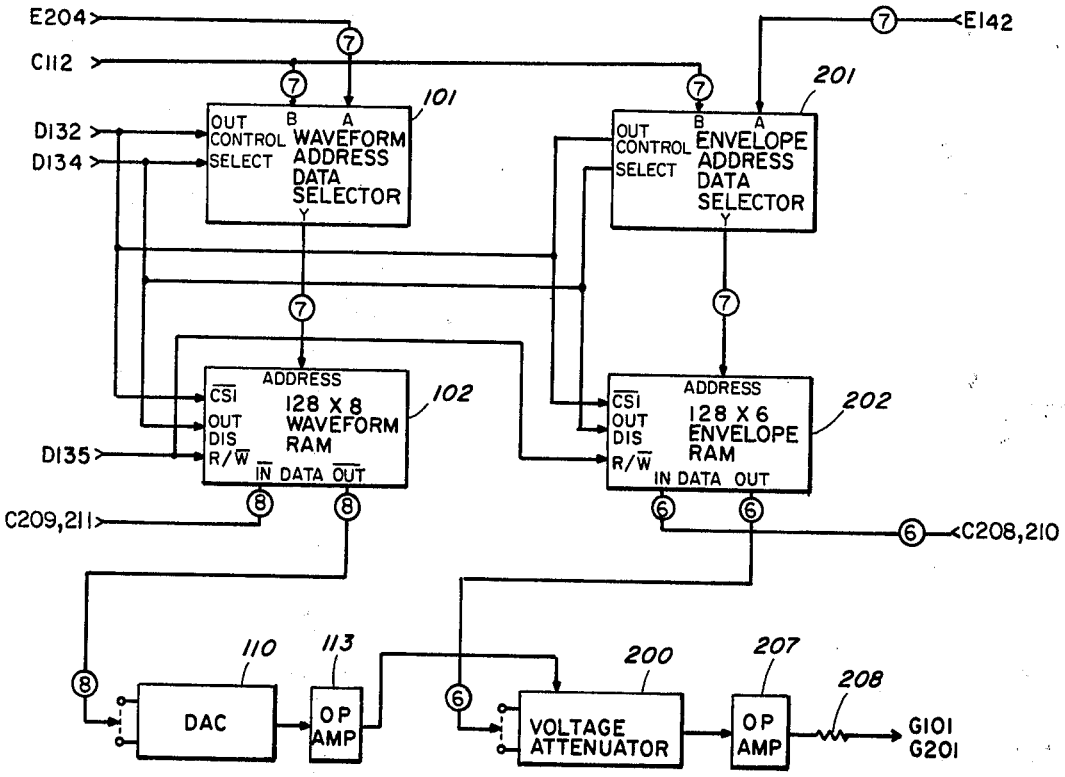

FIG. 7, Circuit F: component

During the transfer process, FF D132 places a low signal on the data selectors' F101, F201 out-control inputs which disables the high impedance state of their outputs, and on the $\overline{CS1}$ inputs of RAMs F102, F202 which places their outputs in a high impedance state. At the same time, FF D134 places a high signal on the select-input of the data selectors F101, F201, which causes the selectors to pass signals from their B-inputs to their Y-inputs, thereby enabling the RAM transfer counter C112 outputs to address the RAM word locations for writing (transfer). The same high signal on the out-disable inputs of the RAMS F102, F202 places their outputs in a high impedance state. Then, with each change of the address, a low pulse from 2-OR D135 on the R/$\overline{W}$ inputs of RAMs F102, F202 writes into the waveform RAM F102 the corresponding data from a selected waveform voice PROM C100 or C300, and into the envelope RAM F202, the corresponding envelope data from a selected envelope voice PROM C200 or C400. At the end of the transfer process, low signals are applied to the select-inputs of the data selectors F101, F201, which cause the selectors to pass signals from their A-inputs to their Y-inputs, thereby enabling the tone frequency counter E204 Q-outputs to address the waveform RAM F102 word locations for reading of waveform point amplitudes, and enabling the keying phase counter E142 Q-outputs to address the keying envelope RAM F202 word locations for reading of envelope point amplitudes, thereby generating binary representations of tones and their envelopes of attack and decay.

The repetitive reading of the successive words stored in waveform RAM F102 by the transfer, applies the resulting binary data to DAC F110 which converts them to bipolar, analog waveform currents which in turn are applied to the digitally controlled voltage attenuator F200. The voltage attenuator F200 can be the device numbered AD7110, manufactured by Analog Devices, Route One, Industrial Park, P.O. Box 280, Norwood, Mass. 02062. Successive binary words received from the read envelope RAM F202 cause the attenuator F200 to vary correspondingly the amplitude of its output of the analog waveform currents applied to it. These conditions are maintained until the low pulse from pulsing-counter D138 clears FF D132, whose resulting high $\overline{Q}$-output places the selectors F101, F201 and RAMs F102, F202 at standby.

Figure 8:
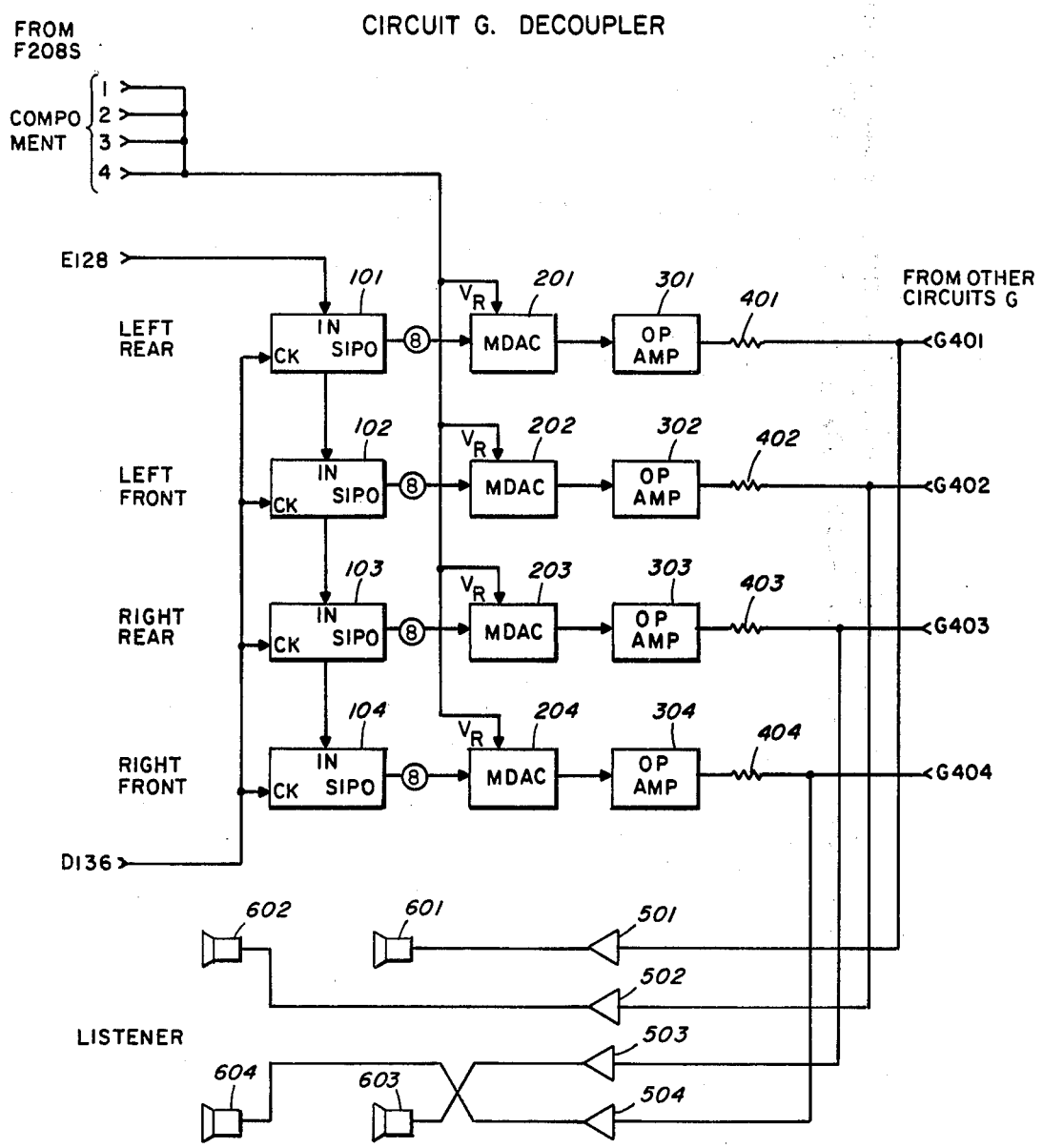

FIG. 8, Circuit G: decoupler

The upper left corner of FIG. 8 shows the channels from the resistors F208 of a note's four component circuits converging to a single common channel that is applied to the reference voltage ($V_R$) inputs of four MDACs G201–G204, inclusive. Four corresponding SIPOs G101–G104, inclusive, apply 8-bit binary signals to the binary inputs of the MDACs, so that the amplitudes of the MDACs' analog outputs assume values corresponding to the binary values of the MDACs' binary inputs. The amplified outputs of the respective MDACs are shown as applied through mixing-summing resistors G401–G404, inclusive, to four corresponding channels. At the right of the figure, the outputs of resistors G401–G404, inclusive, of other notes' decouplers, are shown as applied to the four said channels which, therefore, are common to any desired plurality of notes.

The four said common channels are shown as applied respectively to four corresponding amplifier-speaker systems. Thus, the amplitude of tone currents in speaker 601 corresponds to the tone information transferred to SIPOs G101; the amplitude in speaker G602, to the information in SIPOs G102; the amplitude in speaker G603, to the information in SIPOs G103; and the amplitude in speaker G604, to the information in SIPOs G104. Therefore, the amplitudes in the four speakers depend ultimately on the information stored in the large voice memories and transferred to the SIPOs. Since this information is readily individualized for each separate note of a transfer organ, the standardized circuitry illustrated in FIG. 8's Circuit G effects individualized two-dimensional decoupling of each note from every other note in a transfer organ, as all organ pipes are mutually decoupled.

It is evident that a given array of decouplers can simultaneously duplicate in a single array of four speakers, the sounds of pluralities of organ pipe arrays having different spatial configurations and pipe settings. Thus, for example, some voices can be heard as though coming from pipes in a partially enclosing pipe chamber, at the same time that others are heard as though coming from pipes distributed in the open, as are pipes commonly mounted on the face of an organ.

It is further evident that the different heard locations of the different notes are bi-dimensional stereophonic resultants of sound waves generated by and at the four speakers. These resultants are of phase relations as well as amplitude levels, and duplicate the auditory phenomena of spatial arrays of actual organ pipes.

I claim:

1. An improved electronic transfer organ, comprising in combination:

at least one keyboard having a multiplicity of keys, each said key corresponding to at least one of a multiplicity of nominal pitches to be sounded, each said nominal pitch having associated therewith a range of permissible pitches such that any pitch within that range will be musically acceptable as within the limits of optimal mistuning for that nominal pitch, each said permissible pitch having associated with it harmonics thereof, said permissible pitch and its harmonics being defined herein as a permissible note, at least some of said harmonics having envelopes of attack and decay which are similarly shaped and therefore constitute a component of said permissible note having a composite wave form formed by the waveforms of each of said harmonics;

stop means having at least one stop, each said stop corresponding to a voice to be sounded;

a first group of large memory pairs for a first voice-temperament combination, said group consisting of at least one large memory pair comprising (a) a large waveform-memory having stored therein individualized information comprising the composite waveform of one component of a permissible note associated with a nominal pitch, said component comprising harmonics of the said pitch which harmonics have similarly shaped envelopes of attack and decay, and (b) a large envelope-memory having stored therein information which is individualized regarding the amplitude, frequency, duration of attack and decay, envelope of attack and decay, and spatial position of the said component;

at least one additional group of large memory pairs for at least one additional voice-temperament combination, means for member-actuated selection of one of said groups of large memory pairs thereby enabling voices of the said improved organ to be played in one or more voice arrays and tone temperaments;

at least one array of small memory pairs corresponding to each said large memory pair, said small memory pairs being substantially identical to each other, the number of said small memory pairs in each array being equal to the number of keys that may be desired to activate concurrently;

means responsive to depression of any key to activate one of said small memory pairs in each array to receive information and cause transfer from each of said corresponding large memory pairs of the said individualized information therein corresponding to that depressed key to the respective small memory pairs corresponding to the depressed key for temporary storage therein;

means for causing activation of any stop to convert the information temporarily stored in each small memory pair corresponding to that stop and the depressed key into a signal corresponding to the said component of said permissible note, each said signal being individualized with respect to the composite waveform, frequency, amplitude, duration of attack and decay, envelope of attack and decay, and spatial position of the said component of the permissible note corresponding to the depressed key;

means for producing four amplitude-multiplication factors characteristic of the position of said permissible note in two-dimensional space; and means responsive to said signal and said four amplitude-multiplication factors for generating sounds whose combined acoustic image approximates the acoustic image of an individualized sound source located at said position.

2. An improved electronic transfer organ in accordance with claim 1 wherein there is provided (a) means responsive to release of any depressed key during said attack for initiating decay; and (b) means responsive to depression of any key during decay for initiating attack.

3. An improved electronic transfer organ in accordance with claim 1 wherein at least one of said groups comprises a plurality of large memory pairs corresponding to a plurality of components of a permissible note associated with a nominal pitch, and wherein there is provided summing means for generating a first composite of the signals corresponding to said plurality of said components;

means responsive at least to said transferred spatial position information when a key is depressed, for generating a desired plurality of second composite signals from said first composite each said second composite signal representing a distinctive combination of the waveform, frequency, amplitude, duration of attack and decay, and envelope of attack and decay, of said signals in said first composite;

means responsive to said plurality of second composite signals and said four of amplitude-multiplication factors for generating sounds whose combined acoustic image approximates the acoustic image of a multiplicity of individualized sound sources distributed in at least two spatial dimensions.

* * * * *